US011773578B2

(12) United States Patent
Jung et al.

(10) Patent No.: US 11,773,578 B2
(45) Date of Patent: Oct. 3, 2023

(54) METHOD FOR SELECTING CLEANING COURSE AND BIDET APPARATUS APPLYING THE SAME

(71) Applicant: COWAY CO., LTD., Gongju-si (KR)

(72) Inventors: Seung Hwan Jung, Seoul (KR); Ga Young Kim, Seoul (KR)

(73) Assignee: COWAY CO., LTD., Gongju-si (KR)

( * ) Notice: Subject to any disclaimer, the term of this patent is extended or adjusted under 35 U.S.C. 154(b) by 0 days.

(21) Appl. No.: 17/624,122

(22) PCT Filed: Sep. 9, 2019

(86) PCT No.: PCT/KR2019/011630
§ 371 (c)(1),
(2) Date: Dec. 30, 2021

(87) PCT Pub. No.: WO2021/002531
PCT Pub. Date: Jan. 7, 2021

(65) Prior Publication Data
US 2022/0364347 A1 Nov. 17, 2022

(30) Foreign Application Priority Data
Jul. 1, 2019 (KR) ..... 10-2019-0078852

(51) Int. Cl.
*E03D 9/08* (2006.01)

(52) U.S. Cl.
CPC ..... *E03D 9/08* (2013.01)

(58) Field of Classification Search
CPC ..... E03D 9/08
USPC ..... 4/420.4, 420.5, 447–448
See application file for complete search history.

(56) References Cited

U.S. PATENT DOCUMENTS 6,665,888 B1 * 12/2003 Kwak ..... A61M 3/022 604/185
10,190,302 B2 1/2019 Hashimoto et al.
2017/0275866 A1 9/2017 Hashimoto et al.

FOREIGN PATENT DOCUMENTS

| | | | |
|---|---|---|---|
| JP | 2000-120138 | A | 4/2000 |
| JP | 2017-179712 | A | 10/2017 |
| KR | 20-0414063 | Y1 | 4/2006 |
| KR | 10-0805671 | B1 | 2/2008 |
| KR | 10-2011-0064531 | A | 6/2011 |
| KR | 10-2019-0032842 | A | 3/2019 |

OTHER PUBLICATIONS

International Search Report dated Apr. 1, 2020 in PCT/KR2019/011630 filed Sep. 9, 2019, 2 pages.

* cited by examiner

*Primary Examiner* — Lori L Baker
(74) *Attorney, Agent, or Firm* — Oblon, McClelland, Maier & Neustadt, L.L.P.

(57) ABSTRACT

A method for selecting a cleaning course includes one or more cleaning factors and any one of the one or more emotional factors, in which a cleaning weight of the one or more cleaning factors is preset for each of the one or more emotional factors.

10 Claims, 3 Drawing Sheets

METHOD FOR SELECTING CLEANING COURSE AND BIDET APPARATUS APPLYING THE SAME

FIELD

The present disclosure relates to a method for selecting a cleaning course based on emotional factors that can be considered when using the bidet apparatus, and to a bidet apparatus for performing a cleaning process based on the selected cleaning course.

BACKGROUND ART

A bidet is an apparatus installed in a toilet seat and can spray a jet of water through a nozzle provided in the bidet body to automatically perform anal cleaning, vaginal cleaning, or the like.

To this end, a process of spraying water with a predetermined pressure to the outside from the bidet is required.

There may be various cleaning courses according to cleaning factors such as water pressure, water temperature, presence or absence of sterilization, spraying time period, water spraying area, air injection into water, movement of a cleaning module that sprays water, and the like, each of which can be adjusted through operation on an operation unit provided in the bidet.

However, this involves a drawback of requiring each user to set the optimized cleaning factor for himself or herself directly through the operation unit.

Although there is a difference for each user, the time period to clean the anus or vagina through the bidet is not very long, around 10 seconds. However, the related bidet apparatus requires more time to select a cleaning factor suitable for the user through the direct operation unit than it requires for the cleaning itself.

In particular, for a woman in her menstruation period or a user with an inflamed anal area due to diarrhea, it is necessary to clean the vagina or anus with less water pressure than usual.

In modern society, it is important to provide products with improved performance to consumers, but it is more important to provide products that reflect the needs of consumers.

However, the related bidet simply sprays a jet of water according to the information input to the operation unit without considering the user's condition at all.

The purpose of using a bidet is to prevent genital diseases by cleaning contaminants remaining in the anus or vagina after use of the toilet, but the emotional aspect that makes the user feel comfortable after cleaning is also important.

The related bidets do not take this emotional aspect into account at all. If cleaning is performed in accordance with the user's needs, it will make even a user in poor physical condition feel comfortable after using the toilet. Therefore, customer demand for a bidet that satisfies this emotional aspect is increasing.

Accordingly, the inventors have developed the present invention for selecting a cleaning course in consideration of cleaning weights for different cleaning factors according to emotional factors among the numerous cleaning courses determined according to the cases of combination of cleaning factors and emotional factors.

CITATION LIST

Patent Literature

PTL 1: Korean Patent No. 10-0805671 (Feb. 21, 2008)

PTL 2: Korean Utility Model No. 20-0414063 (Apr. 14, 2006)

SUMMARY

Technical Problem

The present disclosure has been made in order to overcome the problem of a bidet that provides only a single jet of water flow as described above, and accordingly, an object of the present disclosure is to provide an optimal cleaning course in consideration of the user's gender and condition by selecting a cleaning course that considers the emotional factors when using a bidet.

Technical Solution

In an embodiment of the present invention for solving the problems described above, a method for selecting a cleaning course is provided, in which the cleaning course includes one or more cleaning factors and any one of one or more emotional factors, and a cleaning weight of the one or more cleaning factors is preset for each of the one or more emotional factors, and the method includes the steps of (a) by a first cleaning course assignment module 110, assigning different first cleaning courses for each of a number of cases of combinations of one or more cleaning factors, respectively; (b) by a cleaning weighting module 120, giving a preset cleaning weight to each of the one or more cleaning factors, respectively; (c) by an emotional weight calculation module 130, calculating an emotional weight with a preset method by using the cleaning weights for the one or more cleaning factors for each of the one or more emotional factors for each of the first cleaning courses; and (d) by a second cleaning course selection module 140, selecting a plurality of second cleaning courses according to a preset method based on the emotional weight calculated in step (c).

According to an embodiment, the one or more cleaning factors may include any one or more of water pressure, water temperature, presence or absence of sterilization, spraying time period, spraying area of water, pattern of air injection into water, reciprocating speed of a cleaning module 200 through which the water is sprayed.

According to an embodiment, the one or more emotional factors may include any one or more of degree of change in cleaning, cleaning precision, cleaning range, and cleaning sensitivity.

According to an embodiment, when the one or more emotional factors are the degree of change in cleaning, among the one or more cleaning factors: when the spraying area is a first area, a first cleaning weight may be given, when it is a second area larger than the first area, a second cleaning weight greater than the first cleaning weight may be given, and when the spraying area changes during the cleaning course operation time, a third cleaning weight greater than the second cleaning weight may be given; when the pattern of air injection into water is a continuous injection pattern, the second cleaning weight may be given, and when it is a predetermined rhythm injection pattern, the third cleaning weight may be given; and when the reciprocating speed of the cleaning module is a first speed, the second cleaning weight may be given, and when it is a second speed faster than the first speed, the third cleaning weight may be given.

According to an embodiment, when the one or more emotional factors are the cleaning precision, among the one or more cleaning factors: when the spraying area is a first area, a third cleaning weight may be given, when it is a second area greater than the first area, a second cleaning weight less than the third cleaning weight may be given, and when the spraying area changes during the cleaning course operation time, a first cleaning weight less than the second cleaning weight may be given; when the pattern of air injection into water is a continuous injection pattern, the third cleaning weight may be given, and when it is a predetermined rhythm injection pattern, the second cleaning weight may be given; and when the reciprocating speed of the cleaning module is a first speed, the first cleaning weight may be given, and when it is a second speed faster than the first speed, a fourth cleaning weight less than the first cleaning weight may be given.

According to an embodiment, when the one or more emotional factors are the cleaning range, among the one or more cleaning factors: when the spraying area is a first area, a first cleaning weight may be given, when it is a second area larger than the first area, a third cleaning weight greater than the first cleaning weight may be given, and when the spraying area changes during the cleaning course operation time, a second cleaning weight greater than the first cleaning weight and less than the third cleaning weight may be given; when the pattern of air injection into water is a continuous injection pattern, the first cleaning weight may be given, and when it is a predetermined rhythm injection pattern, the second cleaning weight may be given; and when the reciprocating speed of the cleaning module is a first speed, the third cleaning weight may be given, and when it is a second speed faster than the first speed, the second cleaning weight may be given.

According to an embodiment, when the one or more emotional factors are the cleaning sensitivity, among the one or more cleaning factors: when the spraying area is a first area, a first cleaning weight may be given, when it is a second area larger than the first area, a third cleaning weight greater than the first cleaning weight may be given, and when the spraying area changes during the cleaning course operation time, a second cleaning weight greater than the first cleaning weight and less than the third cleaning weight may be given; when the pattern of air injection into water is a continuous injection pattern, the third cleaning weight may be given, and when it is a predetermined rhythm injection pattern, the first cleaning weight may be given; and when the reciprocating speed of the cleaning module is a first speed, third first cleaning weight may be given, and when it is a second speed faster than the first speed, a fourth cleaning weight less than the first cleaning weight may be given.

According to an embodiment, different, preset reference values may be stored in advance according to a number of cleaning factors included in the plurality of first cleaning courses, the step (c) may further include, by way of the emotional weight calculation module 140, calculating the emotional weights by adding the cleaning weights of the one or more cleaning factors included in the plurality of first cleaning courses, and the step (d) may further include, when the emotional weight calculated in the step (c) is equal to or greater than the different, preset reference values according to the number of cleaning factors included in the plurality of first cleaning courses, selecting a corresponding cleaning course as the second cleaning course.

In addition, the present disclosure provides a bidet apparatus applying the method for selecting a cleaning course described above, which may include a toilet seat 1, a main body 4 installed in the toilet seat 1, a seat 3 pivotably mounted on a front side of the main body 4, and a cover 5 pivotably mounted to the seat 3, in which the cleaning module 200 to spray the water and a control unit 100 to control the plurality of cleaning factors are installed inside the main body 4, and any one of the selected plurality of second cleaning courses is performed by the cleaning module 200.

Advantageous Effects

The present disclosure as described above has the following effects.

As the variety of cleaning factors increases, it is possible to select an optimized cleaning course from an exponentially increasing cleaning courses and provide it to the user of the bidet.

In addition, since the emotional factor related to the use of the bidet is used in the process of selecting a cleaning course, it is possible to provide a cleaning course optimized for each user.

In addition, when the bidet cleaning course is operated, it is possible to provide a cleaning course suitable for the user's various conditions.

Through this, it is not necessary to directly control the cleaning factor through the operation unit in order to perform cleaning according to the cleaning course preferred by the user, and as a result, improved convenience can be provided.

DETAILED DESCRIPTION

Figure 1:
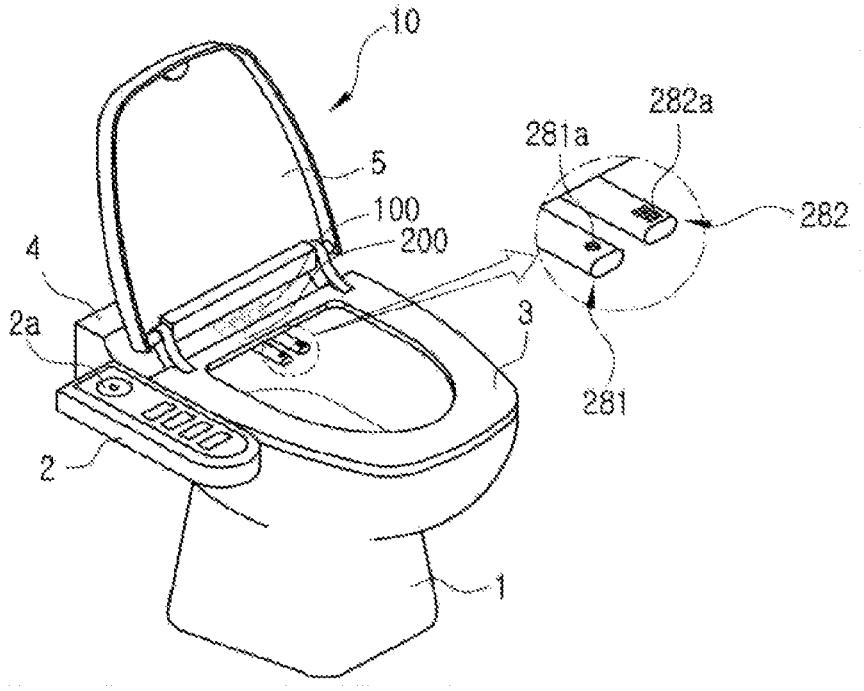
FIG. 1 is a schematic perspective view of a bidet apparatus according to an embodiment of the present disclosure.

Hereinafter, a cleaning method according to embodiments of the present disclosure will be described in detail with reference to the accompanying drawings.

In this process, the thickness of the lines or the size of the components and the like shown in the drawings may be exaggerated for clarity and convenience of explanation. In addition, terms described herein are terms defined in consideration of functions in the present invention, which may vary according to the intention or convention of a user or an operator. Therefore, definitions of these terms should be described based on the content throughout this specification.

Hereinafter, the term "cleaning course" means spraying of water from the bidet apparatus in a predetermined pattern, in which any one cleaning course may include one or more cleaning factors and any one of one or more emotional factors, and may mean a course in which different cleaning courses are sequentially performed for a predetermined time.

1. Description of Bidet Apparatus

Figure 2:
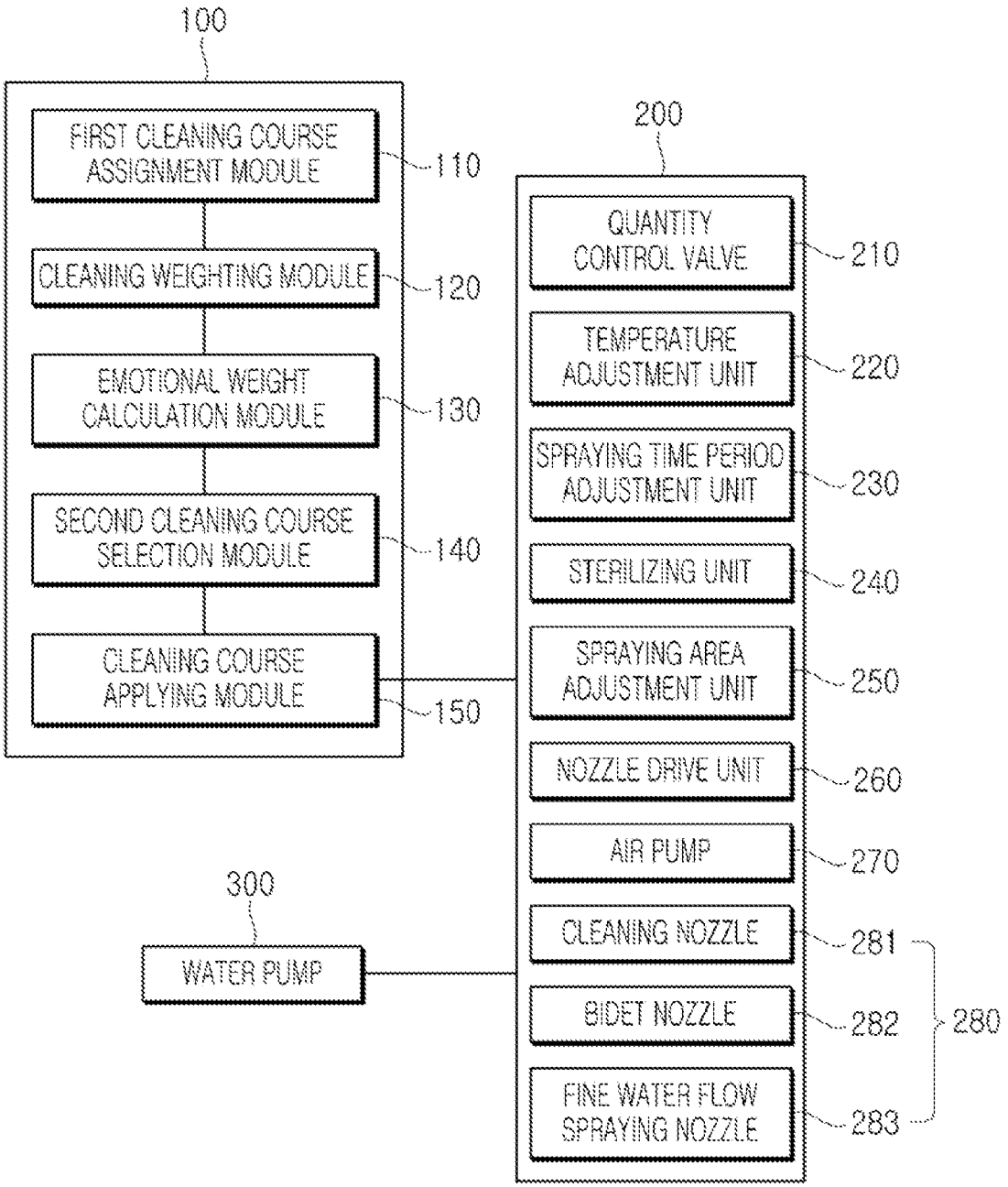
FIG. 2 is a block diagram showing a configuration of a control unit and a cleaning module installed inside the bidet apparatus of FIG. 1.

Referring to FIGS. 1 and 2, a bidet apparatus according to an embodiment of the present disclosure will be described in detail.

FIG. 1 is a schematic perspective view illustrating the bidet apparatus according to an embodiment of the present disclosure.

Referring to FIG. 1, a bidet apparatus 10 may include a main body 4 fixedly installed on a toilet seat 1, a seat 3 pivotably mounted on a front side of the main body 4, a cover 5 pivotably mounted on the seat 3, and an operation unit 2 mounted on the side of the main body 4 to control the cleaning process of a cleaning module 200.

The operation unit 2 is provided with buttons 2*a* for controlling the cleaning factors to be described below. When the user inputs a button 2*a*, the cleaning factor corresponding to the input command is adjusted.

In addition, a control unit 100 and the cleaning module 200 may be installed inside the bidet apparatus 10 according to an embodiment of the present disclosure.

The water supplied through a water pump 300 is sprayed to the outside through the cleaning module 200.

The control unit 100 controls a cleaning factor of the water sprayed from the cleaning module 200, and the cleaning module 200 sprays the water according to the cleaning factor adjusted by the control unit 100.

The control unit 100 may be a microcontroller unit (MCU) having an arithmetic function, or may be a computer having an arithmetic function.

Referring to FIG. 2, the control unit 100 includes a first cleaning course assignment module 110, a cleaning weighting module 120, an emotional weight calculation module 130, and a second cleaning course selection module 140.

The first cleaning course assignment module 110 is a component to assign different first cleaning courses for each of a number of cases of combinations of one or more cleaning factors.

The cleaning factor herein includes all factors applicable to the water according to the operation of each component of the bidet apparatus 10, such as water pressure, water temperature, spraying time period, presence or absence of sterilization, water spraying area, pattern of air injection into water, and reciprocating speed of the cleaning module 200, and in addition to the factors described above, the cleaning factor may include any one that can be applied to the water to change the physical properties of the applied water.

The cleaning factors described above are briefly described below.

For example, the water pressure may have values of a first water pressure, a second water pressure, a third water pressure, a fourth water pressure, and a fifth water pressure, with gradually increasing value from the first water pressure to the fifth water pressure. However, embodiments are not limited thereto, and there may be more or fewer than five values.

The water temperature may have values of a first water temperature, a second water temperature, a third water temperature, a fourth water temperature, and a fifth water temperature, with gradually increasing value from the first water temperature to the fifth water temperature. However, embodiments are not limited thereto, and there may be more or fewer than five values.

The spraying time period means a time period during which the water is sprayed, and the presence or absence of sterilization means the presence or absence of sterilization of the water by a sterilizing unit 240 to be described below.

The spraying area means an area of the water sprayed to the outside, and may include values of a first area, a second area, a third area, a fourth area, and a fifth area, for example. This value gradually increases from the first area to the fifth area. However, embodiments are not limited thereto, and there may be more or fewer than five values.

A change in the spraying area means that the spraying area is not constant, and the spraying area is changed as cleaning is performed.

The air injection means an injection of air into the water by an air pump 270 to be described below, in which a continuous injection pattern means a pattern in which air is continuously injected from the air pump 270, and a rhythm injection pattern means a pattern in which the water is injected into air from the air pump 270 at a predetermined time period.

The cleaning module reciprocating speed means a speed of the cleaning module 200 in forward and backward reciprocating motion, and the second speed is faster than the first speed.

There may be various cases for one cleaning factor. For example, when the water pressure of the water can be adjusted in 1 to 3 stages, any one of the three cleaning factors may be selected for the water pressure.

As described above, the first cleaning course assignment module 110 assigns a first cleaning course according to the number of various combinations of cleaning factors.

For the users who use the cleaning function of the bidet, the most important factor to consider is likely to vary depending on users. One user may consider the feeling of change in water as a major factor in the cleaning process, another user may consider meticulous cleaning as a major factor, still another user may consider the cleaning range as a major factor, and still another user may consider the feeling a gentle cleaning as a major factor.

The degree of change in cleaning, the cleaning precision, the cleaning range, the cleaning sensitivity, and the like described above may be included in the emotional factors of using the bidet, but embodiments are not limited thereto, and any factor related to user emotion may be included.

Hereinafter, embodiments will be described based on the assumption that the emotional factors include four factors: degree of change in cleaning, cleaning precision, cleaning range, and cleaning sensitivity.

The cleaning weighting module 120 is a component to give a preset cleaning weight to each cleaning factor. The cleaning weight of the cleaning factor is preset for each of the emotional factors of the degree of change in cleaning, cleaning precision, cleaning range, and cleaning sensitivity, and the cleaning weighting module 120 gives the preset cleaning weight to the cleaning factor.

Since different cleaning factors will be considered to be important for each emotional factor, the weight of each cleaning factor will be different for each emotional factor.

For example, when the emotional factor is the degree of change in cleaning that considers the feeling of change during the cleaning process as a major factor, the more the cleaning module 200 is reciprocated back and forth, and the faster the reciprocating speed is, the more weight will be given. Table 1 below shows an example of cleaning weights preset in the method for selecting a cleaning course according to an embodiment of the present disclosure.

TABLE 1

| | cleaning factor | | | | | | |
|---|---|---|---|---|---|---|---|
| | spraying area | | | pattern of air injection | | reciprocating speed of cleaning module | |
| emotional factor | first area | second area | change in spraying area | continuous injection pattern | rhythm injection pattern | first speed | second speed |
| Degree of change in cleaning | 1 | 3 | 5 | 3 | 5 | 3 | 5 |
| cleaning precision | 5 | 3 | 1 | 5 | 3 | 1 | 0 |
| cleaning range | 1 | 5 | 3 | 1 | 3 | 5 | 3 |
| cleaning sensitivity | 1 | 5 | 3 | 5 | 1 | 5 | 0 |

An emotional weight calculation module 130 is a component to calculate an emotional weight with a preset method by using cleaning weights of one or more cleaning factors for each of one or more emotional factors for each of first cleaning courses. Specifically, the emotional weight may be calculated by a method of adding the cleaning weights given to the cleaning factors included in the first cleaning course.

Taking Table 1 as an example, when the spraying area is the first area, the air injection pattern is the rhythm injection pattern, and the cleaning module reciprocating speed is the second speed, the emotional weight for the degree of change in cleaning will be 1+5+5=10, the emotional weight for cleaning precision will be 5+3+0=8, the emotional weight for the cleaning range will be 1+3+3=7, and the emotional weight for cleaning sensitivity will be 1+1+0=2.

As described above, the emotional weight calculation module 130 calculates the emotional weight for each emotional factor for each of a plurality of first cleaning courses.

The second cleaning course selection module 140 is a component to select the second cleaning course based on the emotional weight calculated by the emotional weight calculation module 130.

The second cleaning course selection module 140 selects, as the second cleaning course, a course in which the emotional weight calculated for each of the plurality of first cleaning courses is equal to or greater than a reference value set for each emotional factor and for each number of cleaning factors included in the cleaning course.

Specifically, different reference values are preset and stored according to the number of cleaning factors included in the cleaning course, and the reference values increase in proportion to the number of cleaning factors. This is because the cleaning weight is selected for each cleaning factor, and is based on the fact that the cleaning weight increases as the number of cleaning factors included in the cleaning course increases.

As an example, when there is one cleaning factor included in the cleaning course, the reference value may be 5, when there are two cleaning factors, the reference value may be 10, and when there are three cleaning factors, the reference value may be 13.

Taking Table 1 as an example, when the spraying area is the second area, the air injection pattern is the rhythm injection pattern, and the cleaning module reciprocating speed is the first speed, the emotional weight for the degree of change in cleaning will be 3+5+3=11, the emotional weight for cleaning precision will be 3+3+1=7, the emotional weight for the cleaning range will be 5+3+5=13, and the emotional weight for cleaning sensitivity will be 5+1+5=11. Since the number of cleaning factors included in the cleaning course is three, the reference value may be 13, and the second cleaning course selection module 140 may select a cleaning course including the cleaning factors of the second area, the rhythm injection pattern, and the first speed as the second cleaning course for the cleaning range.

As described above, the second cleaning course selection module 140 may select only a cleaning course in which the emotional weight is equal to or greater than a preset reference value to select a cleaning course optimized for each emotional factor, thereby providing an optimized water flow to the user of the bidet.

A cleaning course applying module 150 is a component to apply a second cleaning course selected by the second cleaning course selection module 140 to the cleaning module 200.

The cleaning module 200 is a component to operate according to the cleaning course applied by the cleaning course applying module 150.

Referring to FIG. 2, the cleaning module 200 may include a water quantity control valve 210, a temperature adjustment unit 220, a spraying time period adjustment unit 230, a sterilizing unit 240, a spraying area adjustment unit 250, a nozzle drive unit 260, the air pump 270, and a nozzle 280.

The water quantity control valve 210 is a component to adjust the water pressure of water by adjusting a quantity of water supplied from the water pump 300 and sprayed through the nozzle 280. Since the area of a spraying hole of the nozzle 280, through which the water is sprayed, is constant, the water pressure of the water sprayed to the outside can be adjusted by adjusting a quantity. Since the water quantity control valve 210 is not a core configuration of the present disclosure, detailed description thereof will be omitted.

The temperature adjustment unit 220 is a component to adjust the temperature of water supplied from the water pump 300 and sprayed through the nozzle 280. A corresponding example may include a heating heater, a cooling heater, and the like, but not limited thereto, and any form is applicable as long as it is in such a configuration that can adjust the temperature of the water passing through the nozzle 280.

The spraying time period adjustment unit 230 is a component to adjust a time period during which the water is sprayed through the nozzle 280. For example, it may be provided in the form of a valve, and may be applied to block the flow of the water supplied from the water pump 300. However, embodiments are not limited thereto, and any form is applicable as long as it is in such a configuration that can adjust the spraying time period of water.

The sterilizing unit 240 is a component to sterilize the water. For example, electrolysis may be used to change the properties of water to thus generate sterilizing water, or the water supplied from the water pump 300 may be sterilized in advance and the sterilized water may be stored in a chamber. According to the selected cleaning course, the sterilizing water stored in the sterilizing unit 240 may be sprayed to the outside through the nozzle 280. However, embodiments are not limited thereto, and any form is applicable as long as it is in such a configuration that can sterilize water.

The spraying area adjustment unit 250 is a component to adjust a spraying area of water. For example, the water introduced into the nozzle 280 may have only a straight water flow, and it is possible to adjust the spraying area of the water sprayed to the outside of the nozzle 280 by simultaneously introducing both the straight water flow and a wide water flow into the nozzle 280. However, embodiments are not limited thereto, and any form is applicable as long as it is in such a configuration that can adjust the spraying area of the water. In addition, the spraying area may be adjusted by a movement of the nozzle 280 by the nozzle drive unit 260 to be described below.

The nozzle drive unit 260 is a component that can control the movement of the nozzle 280. Specifically, the nozzle 280 is installed inside the bidet apparatus 10, and the nozzle drive unit 260 may move the nozzle 280 to the outside of the bidet apparatus 10. When the nozzle drive unit 260 moves the nozzle 280, water is sprayed to the outside of the nozzle 280, and accordingly, the cleaning operation is performed. It goes without saying that the nozzle drive unit 260 can adjust the length of the nozzle 280 exposed to the outside.

The air pump 270 is a component to inject air into the water. The air pump 270 is connected to a passage between the water pump 300 and the nozzle 280 and injects air into the water moving from the water pump 300 to the nozzle 280.

The air pump 270 may inject air into the water at a predetermined period. In this case, the user may feel a sense of rhythm due to the periodically injected air.

The nozzle 280 is a component through which the water is sprayed. Water is supplied from the water pump 300, and controlled by each component of the cleaning module 200 and sprayed to the outside through the nozzle 280.

Referring to FIGS. 1 and 2, the nozzle 280 includes a cleaning nozzle 281 and a bidet nozzle 282.

The cleaning nozzle 281 is configured to clean anus of a user, and there is a water flow spraying hole 281*a* formed at one end of the cleaning nozzle 281 to spray water.

The bidet nozzle 282 is configured to clean a vagina of a user, and there are a plurality of fine water flow spraying holes 282*a* formed at one end of the bidet nozzle 282 to spray water. In this example, the diameter of the fine water flow spraying hole 282*a* is preferably smaller than the diameter of the water flow spraying hole 281*a* formed in the cleaning nozzle 281. Accordingly, the water sprayed through the bidet nozzle 282 may be sprayed in the form of a fine water flow having a lower water pressure than the water pressure of the water sprayed through the cleaning nozzle 281. As a result, uncomfortable stimulus to the vagina is kept to a minimum.

2. Description of How to Select Cleaning Course

Figure 3:
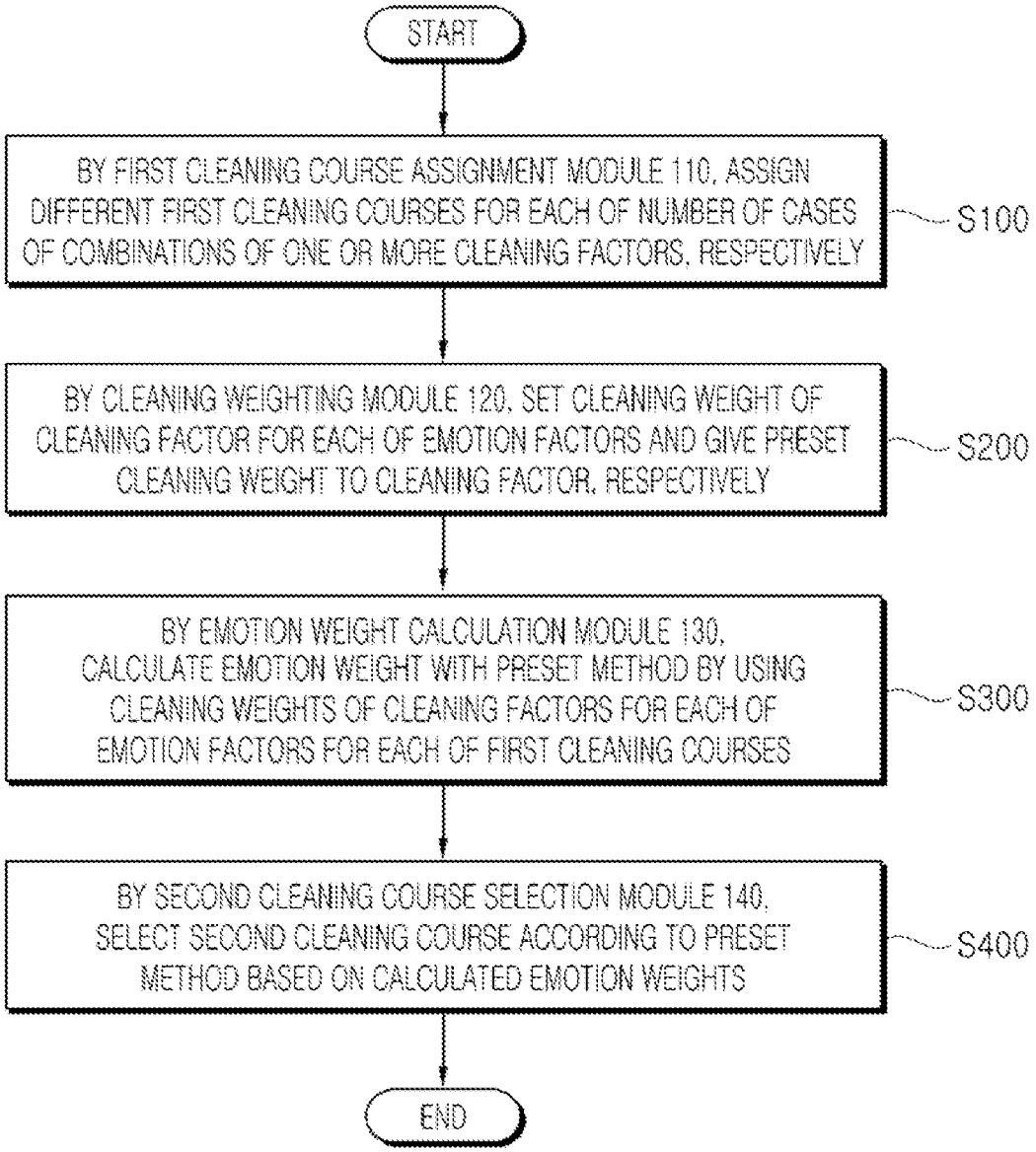
FIG. 3 is a flowchart illustrating a method for selecting a cleaning course according to an embodiment of the present disclosure.

Hereinafter, a cleaning method according to an embodiment of the present disclosure will be described with reference to FIG. 3.

First, (a) the first cleaning course assignment module 110 assigns different first cleaning courses for each of a number of cases of combinations of one or more cleaning factors, respectively (S100).

For example, when it is possible to adjust the water pressure from the first to third stages, adjust the water temperature from the first to fifth stages, and adjust the spraying area from the first to fifth areas, the number of first cleaning courses assigned by the first cleaning course assignment module 110 may be 3×5×5=75.

Next, (b) the cleaning weighting module 130 gives a preset cleaning weight to each of the one or more cleaning factors (S200). Since different cleaning factors will be considered to be important for each emotional factor, the weight of each cleaning factor will be different for each emotional factor, and for example, the cleaning weights shown in Table 1 may be given.

Next, (c) the emotional weight calculation module 130 calculates emotional weights for one or more emotional factors for each of the plurality of first cleaning courses (S300). Each cleaning factor will have different cleaning weights for the emotional factors, and even the same cleaning course will have different cleaning weights calculated for each emotional factor. Specifically, the emotional weight calculation module 130 may calculate the emotional weight by a method of adding the cleaning weights of each cleaning factor included in the cleaning course for each emotional factor.

Thereafter, (d) the second cleaning course selection module 140 selects a plurality of second cleaning courses according to a preset method based on the calculated emotional weights (S400).

Different reference values are preset and stored according to the number of cleaning factors included in the cleaning course, and the second cleaning course selection module 140 selects the cleaning course as the second cleaning course for a specific emotional factor when the sum of the emotional weight calculated by the emotional weight calculation module 130 is equal to or greater than a reference value corresponding to the number of the corresponding cleaning factors.

According to the present disclosure described above, the following effects are obtained.

As the variety of cleaning factors increases, it is possible to select an optimized cleaning course from an exponentially increasing cleaning courses and provide it to the user of the bidet.

In addition, since the emotional factor related to the use of the bidet is used in the process of selecting a cleaning course, it is possible to provide a cleaning course optimized for each user.

In addition, when the bidet cleaning course is operated, it is possible to provide a cleaning course suitable for the user's various conditions.

Through this, it is not necessary to directly control the cleaning factor through the operation unit in order to perform cleaning according to the cleaning course preferred by the user, and as a result, improved convenience can be provided.

The present invention has been described above with reference to the embodiments shown in the drawings to enable those skilled in the art to easily understand and reproduce the present invention, but this is merely exemplary, and those skilled in the art will be able to understand that various modifications and equivalent other embodiments are possible from the embodiments of the present invention. Therefore, the scope of protection of the present disclosure should be determined by the claims.

DESCRIPTION OF REFERENCE NUMERALS

100: control unit
110: first cleaning course assignment module
120: cleaning weighting module
130: emotional weight calculation module
140: second cleaning course selection module
150: cleaning course applying module
200: cleaning module
210: quantity control valve
220: temperature adjustment unit
230: spraying time period adjustment unit
240: sterilizing unit
250: spraying area adjustment unit
260: nozzle drive unit
270: air pump
280: nozzle
281: cleaning nozzle
282: bidet nozzle
283: fine water flow spraying nozzle
300: water pump

The invention claimed is:

1. A method for selecting a cleaning course, the cleaning course comprising one or more cleaning factors and any one of one or more emotional factors, wherein a cleaning weight of the one or more cleaning factors is preset for each of the one or more emotional factors, and the method comprising:

(a) by a first cleaning course assignment module, assigning different first cleaning courses for each of a number of cases of combinations of one or more cleaning factors, respectively;

(b) by a cleaning weighting module, giving a preset cleaning weight to each of the one or more cleaning factors, respectively;

(c) by an emotional weight calculation module, calculating an emotional weight with a preset method by using the cleaning weights for the one or more cleaning factors for each of the one or more emotional factors for each of the first cleaning courses; and (d) by a second cleaning course selection module, selecting a plurality of second cleaning courses in respect to each of the one or more emotional factors according to a preset method based on the emotional weight calculated in step (c), wherein the one or more cleaning factors include any one or more of water pressure, water temperature, presence or absence of sterilization, spraying time period, spraying area of water, pattern of air injection into water, and reciprocating speed of a cleaning module through which the water is sprayed, wherein the one or more emotional factors include any one or more of degree of change in cleaning, cleaning precision, cleaning range, and cleaning sensitivity, wherein different, preset reference values are stored in advance according to a number of cleaning factors included in the plurality of first cleaning courses, the step (c) further includes, by way of the emotional weight calculation module, calculating the emotional weights by adding the cleaning weights of the one or more cleaning factors included in the plurality of first cleaning courses, and the step (d) further includes, when the emotional weight calculated in the step (c) is equal to or greater than the different, preset reference values according to the number of cleaning factors included in the plurality of first cleaning courses, selecting a corresponding cleaning course as the second cleaning course.

2. The method according to claim 1, wherein, when the one or more emotional factors are the degree of change in cleaning, among the one or more cleaning factors:

when the spraying area is a first area, a first cleaning weight is given, when it is a second area larger than the first area, a second cleaning weight greater than the first cleaning weight is given, and when the spraying area changes during the cleaning course operation time, a third cleaning weight greater than the second cleaning weight is given;

when the pattern of air injection into water is a continuous injection pattern, the second cleaning weight is given, and when it is a predetermined rhythm injection pattern, the third cleaning weight is given; and when the reciprocating speed of the cleaning module is a first speed, the second cleaning weight is given, and when it is a second speed faster than the first speed, the third cleaning weight is given.

3. The method according to claim 1, wherein, when the one or more emotional factors are the cleaning precision, among the one or more cleaning factors:

when the spraying area is a first area, a third cleaning weight is given, when it is a second area greater than the first area, a second cleaning weight less than the third cleaning weight is given, and when the spraying area changes during the cleaning course operation time, a first cleaning weight less than the second cleaning weight is given;

when the pattern of air injection into water is a continuous injection pattern, the third cleaning weight is given, and when it is a predetermined rhythm injection pattern, the second cleaning weight is given; and when the reciprocating speed of the cleaning module is a first speed, the first cleaning weight is given, and when it is a second speed faster than the first speed, a fourth cleaning weight less than the first cleaning weight is given.

4. The method according to claim 1, wherein, when the one or more emotional factors are the cleaning range, among the one or more cleaning factors:

when the spraying area is a first area, a first cleaning weight is given, when it is a second area larger than the first area, a third cleaning weight greater than the first cleaning weight is given, and when the spraying area changes during the cleaning course operation time, a second cleaning weight greater than the first cleaning weight and less than the third cleaning weight is given;

when the pattern of air injection into water is a continuous injection pattern, the first cleaning weight is given, and when it is a predetermined rhythm injection pattern, the second cleaning weight is given; and when the reciprocating speed of the cleaning module is a first speed, the third cleaning weight is given, and when it is a second speed faster than the first speed, the second cleaning weight is given.

5. The method according to claim 1, wherein, when the one or more emotional factors are the cleaning sensitivity, among the one or more cleaning factors:

when the spraying area is a first area, a first cleaning weight is given, when it is a second area larger than the first area, a third cleaning weight greater than the first cleaning weight is given, and when the spraying area changes during the cleaning course operation time, a second cleaning weight greater than the first cleaning weight and less than the third cleaning weight is given;

when the pattern of air injection into water is a continuous injection pattern, the third cleaning weight is given, and when it is a predetermined rhythm injection pattern, the first cleaning weight is given; and when the reciprocating speed of the cleaning module is a first speed, the third cleaning weight is given, and when it is a second speed faster than the first speed, a fourth cleaning weight less than the first cleaning weight is given.

6. A bidet apparatus applying the method for selecting a cleaning course according to claim 1, comprising:

a toilet seat;

a main body installed in the toilet seat;

a seat pivotably mounted on a front side of the main body; and a cover pivotably mounted to the seat, wherein the cleaning module to spray the water and a control unit to control the plurality of cleaning factors are installed inside the main body, and any one of the selected plurality of second cleaning courses is performed by the cleaning module.

7. A bidet apparatus applying the method for selecting a cleaning course according to claim 2, comprising:

a toilet seat;

a main body installed in the toilet seat;

a seat pivotably mounted on a front side of the main body; and a cover pivotably mounted to the seat, wherein the cleaning module to spray the water and a control unit to control the plurality of cleaning factors are installed inside the main body, and any one of the selected plurality of second cleaning courses is performed by the cleaning module.

8. A bidet apparatus applying the method for selecting a cleaning course according to claim 3, comprising:

a toilet seat;

a main body installed in the toilet seat;

a seat pivotably mounted on a front side of the main body; and a cover pivotably mounted to the seat, wherein the cleaning module to spray the water and a control unit to control the plurality of cleaning factors are installed inside the main body, and any one of the selected plurality of second cleaning courses is performed by the cleaning module.

9. A bidet apparatus applying the method for selecting a cleaning course according to claim 4, comprising:

a toilet seat;

a main body installed in the toilet seat;

a seat pivotably mounted on a front side of the main body; and a cover pivotably mounted to the seat, wherein the cleaning module to spray the water and a control unit to control the plurality of cleaning factors are installed inside the main body, and any one of the selected plurality of second cleaning courses is performed by the cleaning module.

10. A bidet apparatus applying the method for selecting a cleaning course according to claim 5, comprising:

a toilet seat;

a main body installed in the toilet seat;

a seat pivotably mounted on a front side of the main body; and a cover pivotably mounted to the seat, wherein the cleaning module to spray the water and a control unit to control the plurality of cleaning factors are installed inside the main body, and any one of the selected plurality of second cleaning courses is performed by the cleaning module.

* * * * *